US007651161B2

(12) United States Patent
Anselmi et al.

(10) Patent No.: US 7,651,161 B2
(45) Date of Patent: Jan. 26, 2010

(54) TABLE SEAT WITH ROTATABLE SITTING PORTION

(75) Inventors: Lorenzo Anselmi, Varese (IT); Luciano Pedretti, Como (IT)

(73) Assignee: Artsana S.p.A., Grandate (IT)

( * ) Notice: Subject to any disclaimer, the term of this patent is extended or adjusted under 35 U.S.C. 154(b) by 74 days.

(21) Appl. No.: 12/022,582

(22) Filed: Jan. 30, 2008

(65) Prior Publication Data

US 2008/0203780 A1 Aug. 28, 2008

(30) Foreign Application Priority Data

Feb. 23, 2007 (IT) ..... MI2007A0348

(51) Int. Cl.
*A47D 1/10* (2006.01)

(52) U.S. Cl. ..... 297/174 CS

(58) Field of Classification Search ..... 297/174 CS, 297/137, 135, 174 R, 344.21
See application file for complete search history.

(56) References Cited

U.S. PATENT DOCUMENTS 2,812,012 A 11/1957 Hansburg
3,126,226 A * 3/1964 Johnson ..... 297/174 CS
5,451,093 A 9/1995 Petrie et al.
6,679,549 B2 * 1/2004 Catelli ..... 297/174 CS

FOREIGN PATENT DOCUMENTS

EP 1 317 896 A1 6/2003

* cited by examiner

*Primary Examiner*—Milton Nelson, Jr.
(74) *Attorney, Agent, or Firm*—Oblon, Spivak, McClelland, Maier & Neustadt, L.L.P.

(57) ABSTRACT

A table seat (1) comprising a foldable frame (1A) supporting an at least partially foldable container or sitting portion (2) for receiving and supporting a child, said frame (1A) comprising opposing lateral portions (3) enabling the seat (1) to be removably fixed to a top (5) of the table (6), each portion (3) comprising an upper arm (10) and a lower arm (11) which are superposed, the second arm (11) comprising at least one movable intermediate portion (17) arranged to lowerly contact said table top (5) and at least one end portion (16), the child container (2) being associated with a support portion (50) fixed to said lateral portions (3). The child container or sitting portion (2) comprises a structure (55) rotatably associated with said support portion (50) and enabling the child to be arranged in different spatial positions relative to the table (6), said structure (55) being rotatable about a central axis (W) perpendicular to a geometrical plane parallel to said table top (5).

12 Claims, 5 Drawing Sheets

TABLE SEAT WITH ROTATABLE SITTING PORTION

The present invention relates to a table seat for children.

A table seat is known to comprise a foldable frame fixable to the table and supporting an at least partly foldable container or sitting portion for containing a child. The frame comprises lateral portions enabling it to be fixed to a table top, said portions each presenting a pair of superposed arms: a first arm is positioned above said (flat) table top, while the second arm is positioned below the table top and comprises means for removably clamping that seat portion to the table. EP1317896 describes such a seat; in this latter, each lateral frame portion presents a lower arm defined by a tubular structure and provided with a movable intermediate portion to removably contact the underside of said table top. Said second arm of the seat described in the prior European patent is bent towards the table top and cooperates with it to securely clamp the seat to the table.

In known table seats, the child container or sitting portion is fixed to the frame. This fact prevents the child from assuming different axial positions relative to the table. In this respect, if the child needs to be rotated in a direction lateral to the table top, this cannot be done with known arrangements, in which the child always faces the table.

An object of the present invention is therefore to provide a table seat with which the spatial position of the child can be modified relative to the flat table top such that the child can be turned in a direction away from the table top.

Another object is to provide a table seat of the aforestated type which enables the child to be orientated in stable positions relative to the table top.

A further object is to provide a table seat of the aforesaid type which is simple to construct and use.

These and further objects which will be apparent to the expert of the art are attained with a table seat in accordance with the accompanying claims.

The present invention will be apparent from the accompanying drawings, which are provided by way of non-limiting example, and in which.

Figure 1:
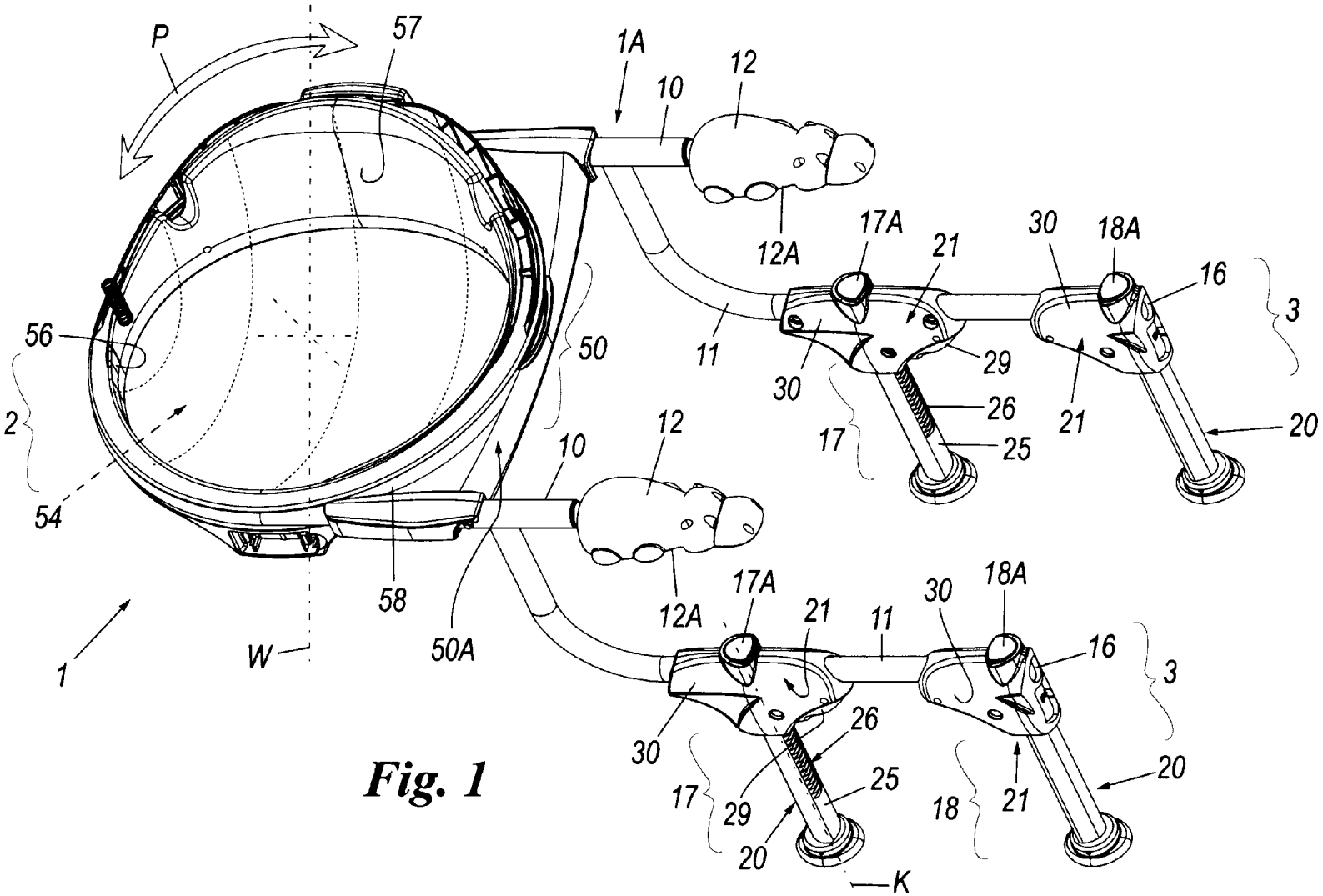
FIG. 1 is a perspective view of a table seat of the present invention, shown in a particular position of use.

With reference to said figures, a table seat is indicated overall by 1 and comprises a foldable frame 1A, and an enclosure or container or sitting portion 2, also at least partly foldable, able to support a child. The frame 1 comprises lateral portions 3 enabling the seat to be fixed to a top 5 of a table 6, said top presenting an upper surface 7 and a lower surface 8.

Each lateral portion comprises an upper first arm 10 and a lower second arm 11, the first carrying a stop 12 with an anti-slip lower surface 12A, to be positioned on the surface 7 of said top 5, the second 11 to be positioned at the surface 8 thereof. Both the arms have a tubular structure. The second arm 11 presents a free end 16 and supports at least one intermediate portion 17; an end portion 18, functionally similar or identical to the portion 17, is associated in the example with the free end 16 of said arm 11.

The portions 17 and 18 comprise end parts 17A and 18A of high friction coefficient material for contacting the surface 8 of the top 5, to prevent any mutual slippage. However as an alternative, the portion 18 could be replaced by an arched part terminating with an element of high friction coefficient, to contact the surface 8 of the top 5 of the table 6.

As already described in EP1317896, the intermediate portion 17 of the second arm 11 of each lateral portion 3 comprises a tubular element 20 slidable within a fixed part 21 rigid with the arm 1. Each element 20 is movable along its longitudinal axis K within the fixed part 21. The interior of the tubular element can be formed as described in EP1317896, which is considered incorporated in the present text by reference.

On its outer surface 25 the tubular element 20 comprises a toothed portion 26 with teeth having, in longitudinal section, a rectangular trapezium shape (or rectangular triangle, not shown). Consequently, each tooth presents a side disposed perpendicular to the said surface 25 (to define an undercut therein) and an inclined opposing side. This toothed portion 26 cooperates with a locking member (or lever or trigger piece) 29 associated with the fixed part 21 and arranged to block the movement of the element 20 along the axis K.

More particularly, the fixed part 21 comprises a piece 30, containing the locking member 29, fixed to the tubular structure of each lower arm 11. This fixed part 21, the locking member 29 (in the form of a lever or trigger part) and the container 30 can also be formed as described in EP1317896, to which reference should be made for a more detailed description.

In the example, the portion 18 is identical to the aforedescribed portion 17; consequently, elements or components corresponding to those of this latter are indicated by the same reference numerals.

When the seat is positioned on the top 5 of the table 6, each portion 17 and 18 of the second arm 11 of each lateral portion 3 lies below this top. To fix the seat to the top, this portion is pushed towards the surface 8 of the top 5, to obtain free movement of the portion relative to the corresponding arm 11. This movement towards the top 5 is free. The movement lasts until each portion 17 and 18 makes contact with the top.

The position attained is stable in that each tubular element 20 has its toothed portion 26 locked, in the position attained within the fixed part 21, by the locking member 29.

To remove the seat, this locking member or trigger 29 is firstly pressed. The tubular element 20 is detached from the top 5 and is brought into the position of FIGS. 1 and 2.

The frame 1A comprises a part 50 supporting the enclosure 2 (or container or sitting portion) for supporting a child. According to the invention, this enclosure or container or sitting portion 2 can rotate about a central axis W perpendicular to the geometrical plane in which the surface 7 of the table 6 lies; this enables the child to be orientated towards this surface 7 or be turned in other directions to this latter. In addition, advantageously and preferably, the sitting portion or enclosure or container 2 is lockable in a plurality of angularly different positions relative to the part 50 of the frame 1A.

More particularly, the enclosure or sitting portion 2 comprises a rigid structure 55 (fixed to the part 50 of the frame 1A) and a flexible structure 54, generally of fabric or the like, associated with the rigid structure 55 and in which the child is positioned.

Figure 2:
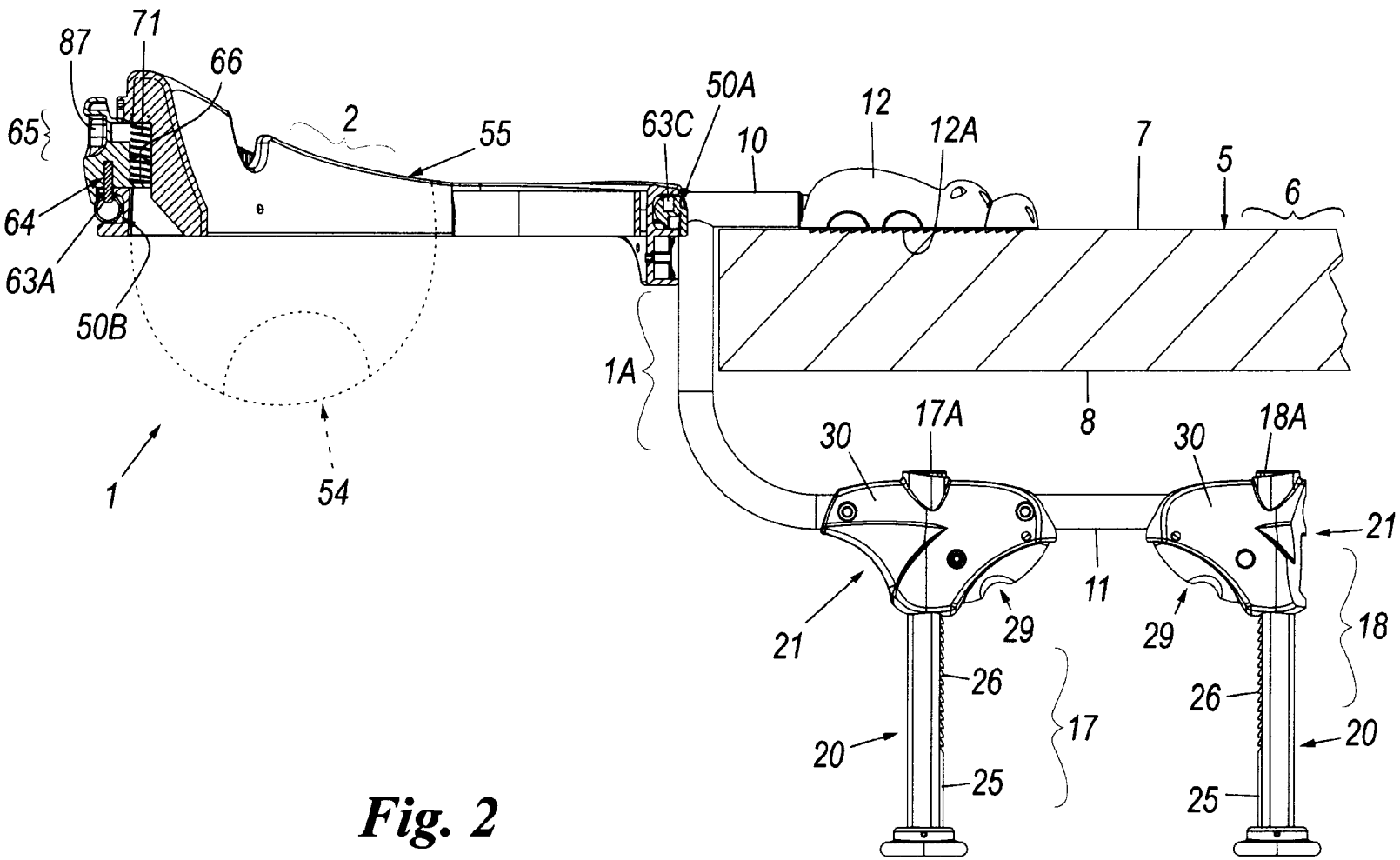
FIG. 2 is a side view of the seat of FIG. 1, with certain parts in section for greater clarity, but in a different position of use.

The flexible structure is shown dashed in FIGS. 1 and 2.

The rigid structure 55 comprises an annular part 56 provided with a raised edge 57 acting as a backrest for the seat 2. The annular part 56 also comprises a perimetral outer recess 58 (C-shaped) to receive the part 50 of the frame 1A. This part comprises a first tubular element 50A to which the lateral portions 3 of the frame are removably coupled, and a U-shaped second element 50B (formable by connecting together a plurality of rectilinear and curved components).

These elements cooperate directly with the perimetral outer recess 58 of said annular part 56 and are received in this latter (the element 50A only partially via an edge portion 50K thereof).

The annular part 56 can be locked in a plurality of relative positions angularly spaced apart (for example by 90°) about the part 50 of the frame 1A or about the elements 50A and 50B thereof. For this purpose, spaced-apart holes 63A, 63B, 63C and 63D are provided in said elements along a circumference, to receive a pin 64 rigid with a operating member 65 for rotating the seat 2 about the part 50 of the frame 1A.

Specifically, said operating member 65 is associated with a seat 66 provided in the annular part 56 of the seat 2, preferably in the raised edge 57 of said part. The operating member 65 comprises a seat 70 for a compression spring 71, said seat being defined by lateral perimetral walls 72 and 73, a lower wall 74 and an upper wall 75. This latter is open at 76 to receive a projecting lug 78 on the top 79 of the seat 66 of the part 56. The side walls 72 and 73 of said seat 70 are arranged to cooperate with guide shoulders 80 rising from a base 81 of the seat 66 on which the lower wall 74 of the seat 70, and generally the member 65, is supported when at rest.

In the base 81 of the seat 66 a hole 83 is provided to receive therethrough said pin 64, said pin being fixed in the operating member 65. Finally, this latter presents a surface recess 87 acting as a handgrip for moving the member 65 within the seat 66 of the annular part 56, this movement being necessary to release the sitting portion 2 and enable it to rotate about the axis W.

Figure 3:
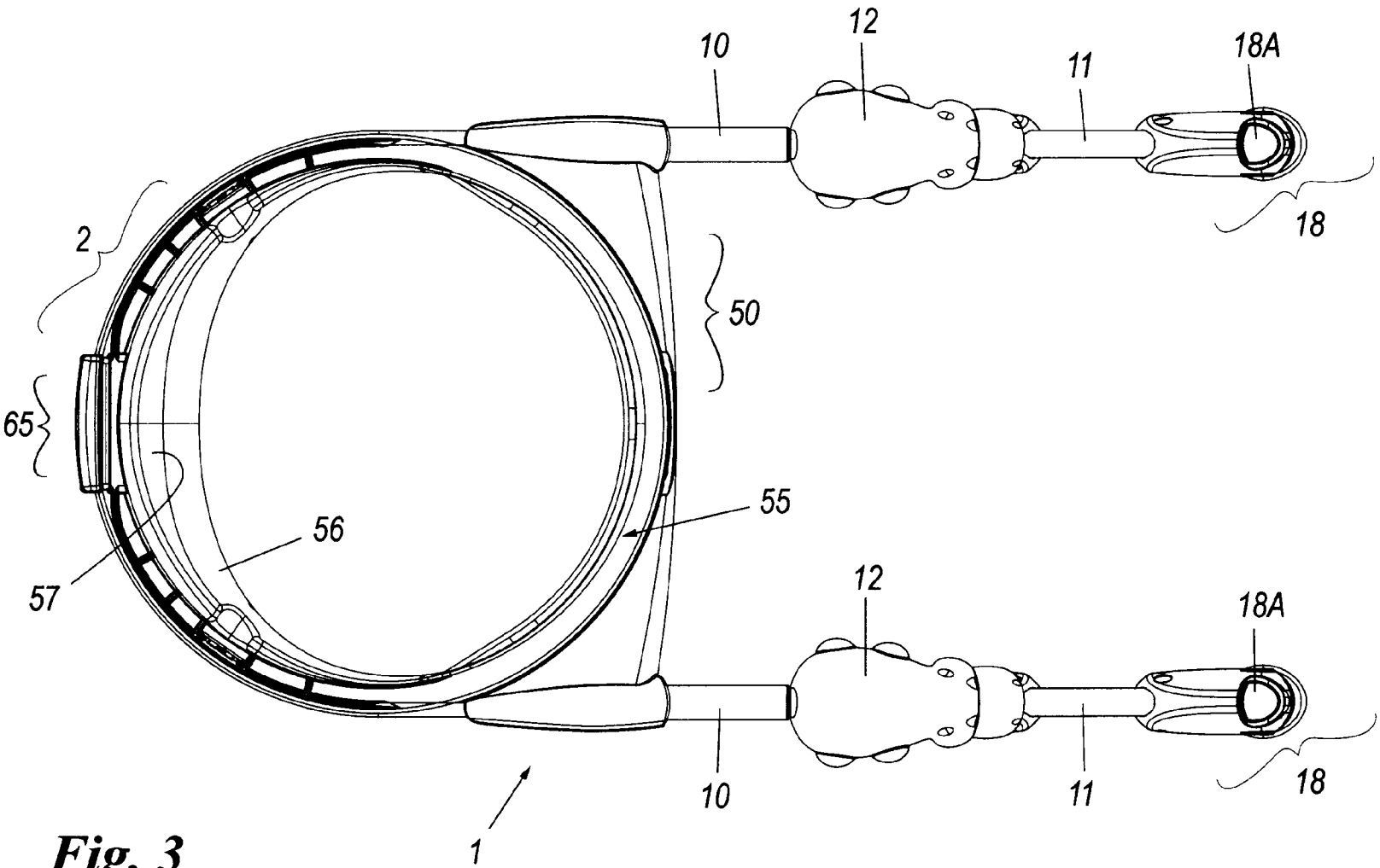
FIG. 3 is a view of the seat of FIG. 2 from above.
Figure 4:
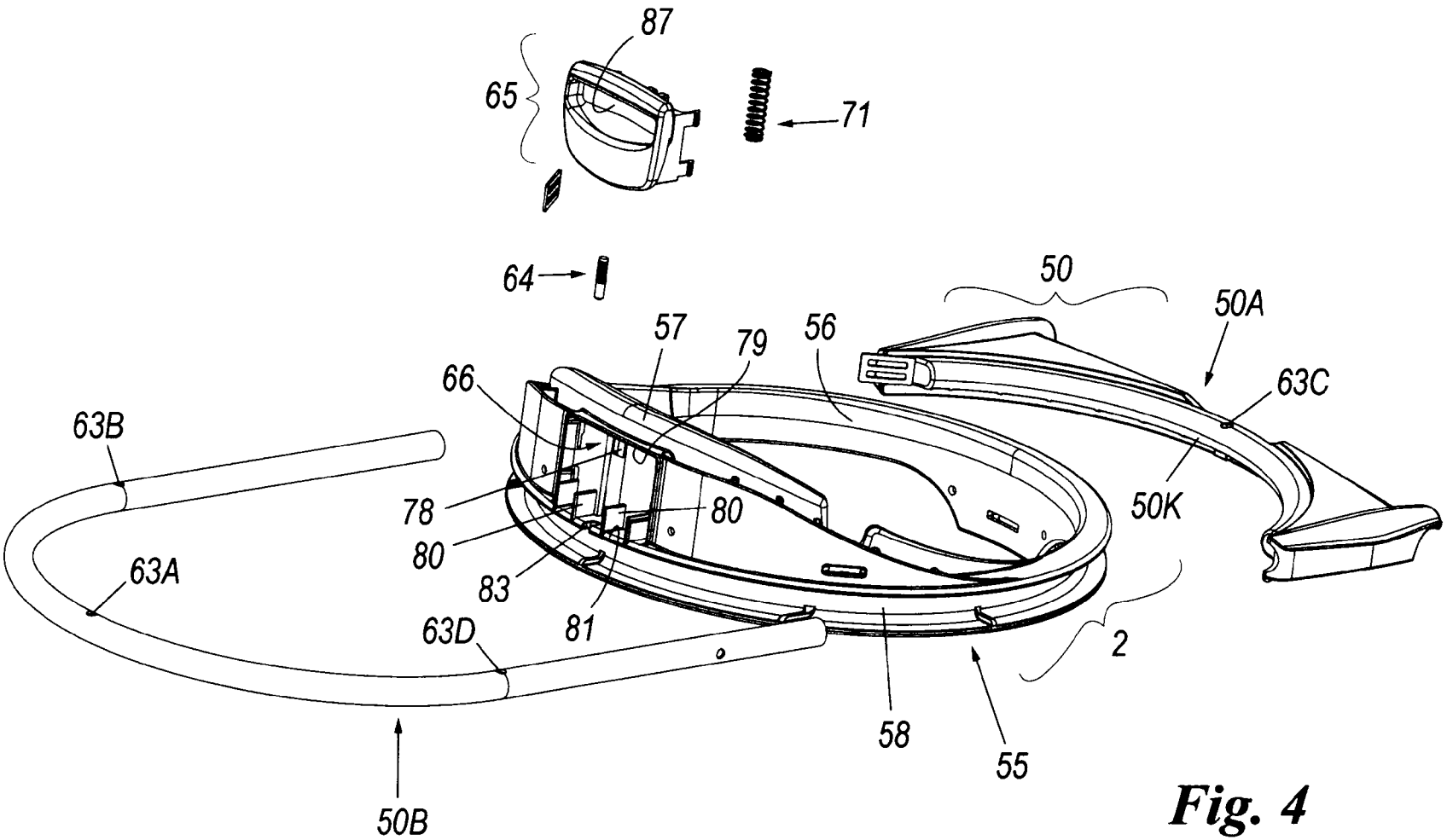
FIGS. 4 and 5 are exploded perspective views of the seat of FIG. 2, seen from two different angles.
Figure 5:
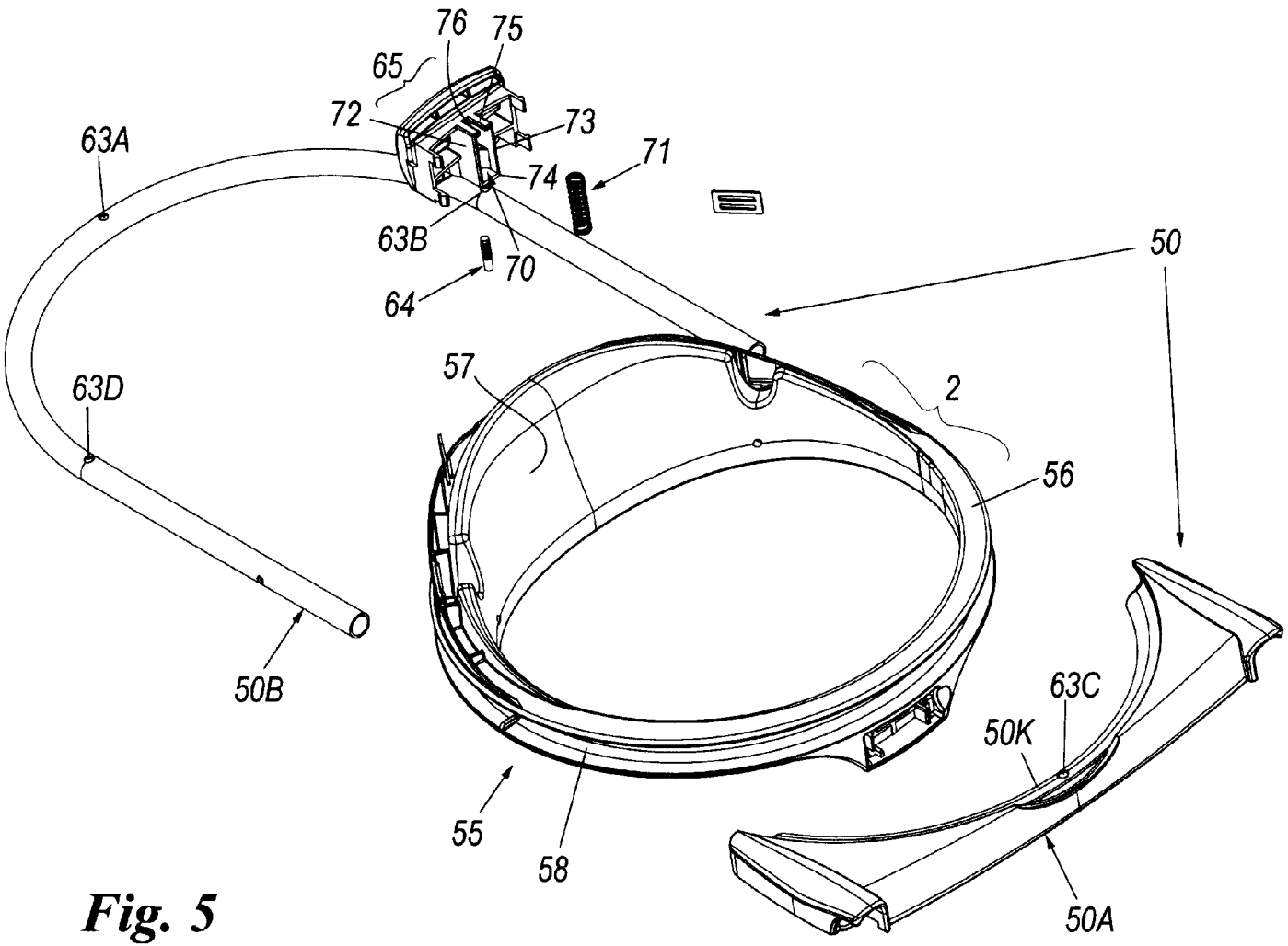

It will now be assumed that the seat 1 contains the enclosure or sitting portion 2 in the position of FIG. 2 or FIG. 3. To rotate it (arrow P of FIG. 1) into the position shown in FIG. 1, a user grips the operating member 65 by the handgrip or recess 87 and moves it within the seat 66 of the annular part 56 towards the top 89 of said seat. During this movement, the member 65 is opposed by the action of the lug 78 against the compression spring 71.

By said movement, the pin 64 is extracted from the hole 63A. By simultaneously rotating the sitting portion 2 on the part 50 of the frame 1A and releasing the operating member 65, the pin 64, essentially urged by the spring 71, finally rests on the second tubular element 50B of the frame part 50, to enable rotation to be continued until said pin 64 reaches the hole 63B into which, again urged by the spring 71, it is forced to penetrate. Rotation of the sitting portion 2 is hence halted and the child seated therein now looks in a direction perpendicular to the plane 5 of the table 8.

The seat of the invention is of simple construction and utilization, and offers considerable versatility of use.

A preferred embodiment of the invention has been described. Others are however possible, such as one in which the part 50 is shaped differently or which comprises an annular part with its edge simply flanged (not recessed to C-shape) and resting on said part 50. These different embodiments are also to be considered as falling within the scope of the present invention.

The invention claimed is:

1. A table seat comprising:

a seat frame that is foldable and that supports an at least partially foldable child container or sitting portion configured to receive and support a child, said seat frame comprising opposing lateral portions enabling the table seat to be removably fixed to a top of a table, each lateral portion comprising an upper first arm and a lower second arm, the first arm and the second arm being superposed, the second arm comprising at least one movable intermediate portion arranged to cooperate with a lower surface of the top of the table and at least one end portion, the child container being associated with a support portion fixed to said lateral portions, the child container or sitting portion including a rotatable structure that is rotatably associated with said support portion and enabling the a child received and supported in the child container or sitting portion to be arranged in different spatial positions relative to the table, said rotatable structure being rotatable about a central axis perpendicular to a geometrical plane parallel to said table top.

2. A table seat as claimed in claim 1, wherein the rotatable structure comprises a rigid part associated rotatably with the support portion of the seat frame at a flexible structure configured to receive a child, said flexible structure being associated with the rigid part, the rigid part being of annular shape.

3. A seat as claimed in claim 2, wherein the rigid part of annular shape comprises at least one projecting perimetral edge resting on the support portion of the seat frame.

4. A seat as claimed in claim 2, wherein the rigid part of annular shape comprises an outer perimetral recess that is C-shaped in cross section and that is arranged to receive, by relative sliding, the support portion of the seat frame.

5. A seat as claimed in claim 1, further comprising means for locking the sitting portion in particular angular positions on the support portion of the seat frame.

6. A seat as claimed in claim 5, wherein said locking means are at least one pin configured to cooperate with a plurality of holes distributed along the support portion of the seat frame.

7. A seat as claimed in claim 6, wherein the pin is associated with an operating member that is movable against a spring within a seat provided in a rigid part of annular shape.

8. A seat as claimed in claim 6, wherein the plurality of holes are spaced apart by predefined angles.

9. A seat as claimed in claim 8, wherein the plurality of holes are four holes that are spaced 90° apart.

10. A seat as claimed in claim 1, wherein the movable intermediate portion of the second arm comprises a hollow tubular element that is movable along its a longitudinal axis of the second arm relative to said second arm, said hollow tubular element being slidable within a part fixed to said second arm.

11. A seat as claimed in claim 1, wherein a movable portion identical to the movable intermediate portion is associated with the end portion of each lower arm.

12. A seat as claimed in claim 1, wherein the support portion of the seat frame comprises a first tubular element with which the opposing lateral portions of said seat frame are associated, and a substantially U-shaped second element.

* * * * *